US006622740B1

(12) United States Patent
Durazzani

(10) Patent No.: US 6,622,740 B1
(45) Date of Patent: Sep. 23, 2003

(54) DISHWASHING MACHINE, PREFERABLY FOR HOME USE, WITH AN IMPROVED ARCHITECTURE

(75) Inventor: Piero Durazzani, Porcia (IT)

(73) Assignee: Electrolux Zanussi, S.p.A., Pordenone (IT)

( * ) Notice: Subject to any disclaimer, the term of this patent is extended or adjusted under 35 U.S.C. 154(b) by 0 days.

(21) Appl. No.: 09/980,205

(22) PCT Filed: Apr. 18, 2000

(86) PCT No.: PCT/EP00/03510

§ 371 (c)(1),
(2), (4) Date: Feb. 12, 2002

(87) PCT Pub. No.: WO00/72741

PCT Pub. Date: Dec. 7, 2000

(30) Foreign Application Priority Data

Jun. 1, 1999 (IT) ..... PN99A0043

(51) Int. Cl.[7] ..... B08B 3/00; B08B 3/12

(52) U.S. Cl. ..... 134/201; 134/115 R; 134/143; 134/165; 134/200; 312/228; 312/228.1; 312/271; 312/273; 312/274; 312/298; 312/301

(58) Field of Search ..... 134/115 R, 143, 134/165, 200, 201; 312/228, 228.1, 271, 273, 274, 298, 301

(56) References Cited

U.S. PATENT DOCUMENTS

| | | | | | |
|---|---|---|---|---|---|
| 2,216,388 | A | * | 10/1940 | Hampel | 134/200 X |
| 2,661,750 | A | * | 12/1953 | McNairy | 134/115 R |
| 2,703,581 | A | * | 3/1955 | Culhane | 134/133 |
| 3,376,087 | A | | 4/1968 | Hardy | |
| 3,466,105 | A | * | 9/1969 | Guth | 312/274 |
| 3,466,108 | A | * | 9/1969 | Guth | 312/274 |
| 5,115,822 | A | | 5/1992 | Nichols | |
| 6,260,565 | B1 | * | 7/2001 | Welch et al. | 134/201 X |

FOREIGN PATENT DOCUMENTS

WO 98/33426 8/1998

* cited by examiner

*Primary Examiner*—Randy Gulakowski
(74) *Attorney, Agent, or Firm*—Pearne & Gordon LLP

(57) ABSTRACT

A dishwashing machine comprises a stationary housing with an open front face and at least two structures for supporting wash load items. The support structures are able to slide horizontally with respect to the housing through the open front face of the housing. At least one of the support structures is capable of sliding horizontally jointly with a door, which closes the open front face of the housing, and is adapted to move in a substantially vertical direction along an inner surface of the door. The inner surface of the door is able to accommodate the front bulk of at least another one of the remaining support structures.

8 Claims, 3 Drawing Sheets

DISHWASHING MACHINE, PREFERABLY FOR HOME USE, WITH AN IMPROVED ARCHITECTURE

This application claims the benefit of International Application Number PCT/EP00/03510, which was published in English on Dec. 7, 2000.

The present invention relates to a dishwashing machine preferably, although not exclusively for home use.

The typical architecture of a machine of the above mentioned kind is generally known to comprise, within a structural outer casing, a washing vessel which is in most cases made of stainless steel and has an open front face so as to enable the washload items to be conveniently loaded and unloaded into and from it. Such washload items are generally arranged on two or more racks that are capable of sliding horizontally and are sprayed by some rotating spray arms. The above cited front face of the washing vessel of the machine is adapted to be closed by a door hinged on the lower edge thereof. Through the inner surface of such a door, the user is then able to gain access to the washing and rinsing product (ie. detergents, rinsing aids and the like) dispensing means.

While the performance capabilities of dishwashing machines in terms of cleaning effectiveness, efficiency in the usage of energy and water, as well as noise generation during operation have improved to a significant extent as compared with the first models of such machines that appeared on the market approx. forty or fifty years ago, the architecture of present-day dishwashing machines has on the contrary remained substantially the same.

To the best knowledge of the Applicant, there are currently no dishwashing machines on the market which are known to have an architecture that might constitute a reference for the present invention. It is anyway felt adequate to hint in this context at some proposals of so-to-say rather unconventional designs, ie. constructional solutions, that are however not known to have ever been able to find any practical implementation.

DE-A-2 820 778 discloses a machine constituted by functional blocks, all of which made of moulded thermoplastic material. Two of such functional blocks consist of a pair of drawers arranged one above the other one and adapted to be loaded with the washload items. These drawers are capable of sliding with respect to the washing vessel of the machine individually, ie. in a fully independent manner from each other. When said drawers are in their retracted position, their front panels shut the open front face of the washing vessel. To each one of said drawers there are associated a rotating spray arm and a tubular connection that is capable to be connected in a bayonet-joint manner to a water supply conduit provided outside the washing vessel. It should finally be noticed that, in this washing machine, the position of the washing and rinsing aid dispensers is on the control panel located above the open front face of the washing vessel.

Italian utility model No. 140 081 discloses in turn a dishwashing machine in which the washload items are supported by three racks arranged above one another and capable of sliding horizontally through the open front face of the washing vessel in a manner that is fully independent from each other. The sole architectural difference that can be noticed here with respect to a traditional dishwashing machine consists in that the rack located in the highest position, ie. on top of the other ones, is firmly joined to a front panel, which therefore is also capable of sliding with respect to the washing vessel so as to be able to partially close the front face thereof. The other two racks, which are capable of being removed from the washing vessel even separately from each other, are located behind a traditional loading door that is hinged along the lower edge and is so adapted to close the remaining portion of the open front face of the washing vessel. No further innovative features can be found in this patent as far as the actual architecture of the machine is concerned, its particularly stated purpose being merely to point out that the most delicate washload items are in fact loaded on the upper rack and sprayed by less intensive water jets.

In US-A-2 668 091, the washing vessel of a dishwashing machine designed to be built under a counter or kitchen sink worktop is capable of being loaded through the upper face thereof, which is adapted to be closed by means of a lid hinged along a horizontal axis. Apart from the inconvenience resulting for the user from the need for the racks loaded with the washload items to be lifted and lowered through the open upper face of the washing vessel, a machine of such a kind appears to be scarcely reliable owing to the fact that it is fully slidable horizontally on rails that are attached to the cabinet carrying the kitchen sink.

The dishwashing machine disclosed in IT-A-76 1 058 is characterized in that it is provided with a small water-tight chamber located inside the washing vessel to the purpose of allowing for "a small amount of washload items, such as for example the ones used by an average household for breakfast, to be washed separately". Such a function of said small water-tight chamber, while certainly plausible in the mid of the Sixties, when this patent has actually been filed, is clearly inconsistent with the current push towards a reduction in energy and water usage, so that washing cycles tend to be only carried out when the dishwashing machine is loaded to its full rated capacity.

It therefore is a main purpose of the present invention to provide a dishwashing machine that has an architecture which is definitely innovative and, moreover, offers a level of convenience that is far greater than the one of traditional machines, while ensuring performance and efficiency capabilities that are in full compliance with the newest, most demanding environment-protection regulations and directives.

The features of the machine enabling this and further aims to be reached are recited in the appended claims.

Anyway, characteristics and advantages of the present invention will become more readily apparent from the description that is given below by way of non-limiting example of implementation with reference to the accompanying drawings, in which.

Figure 1:
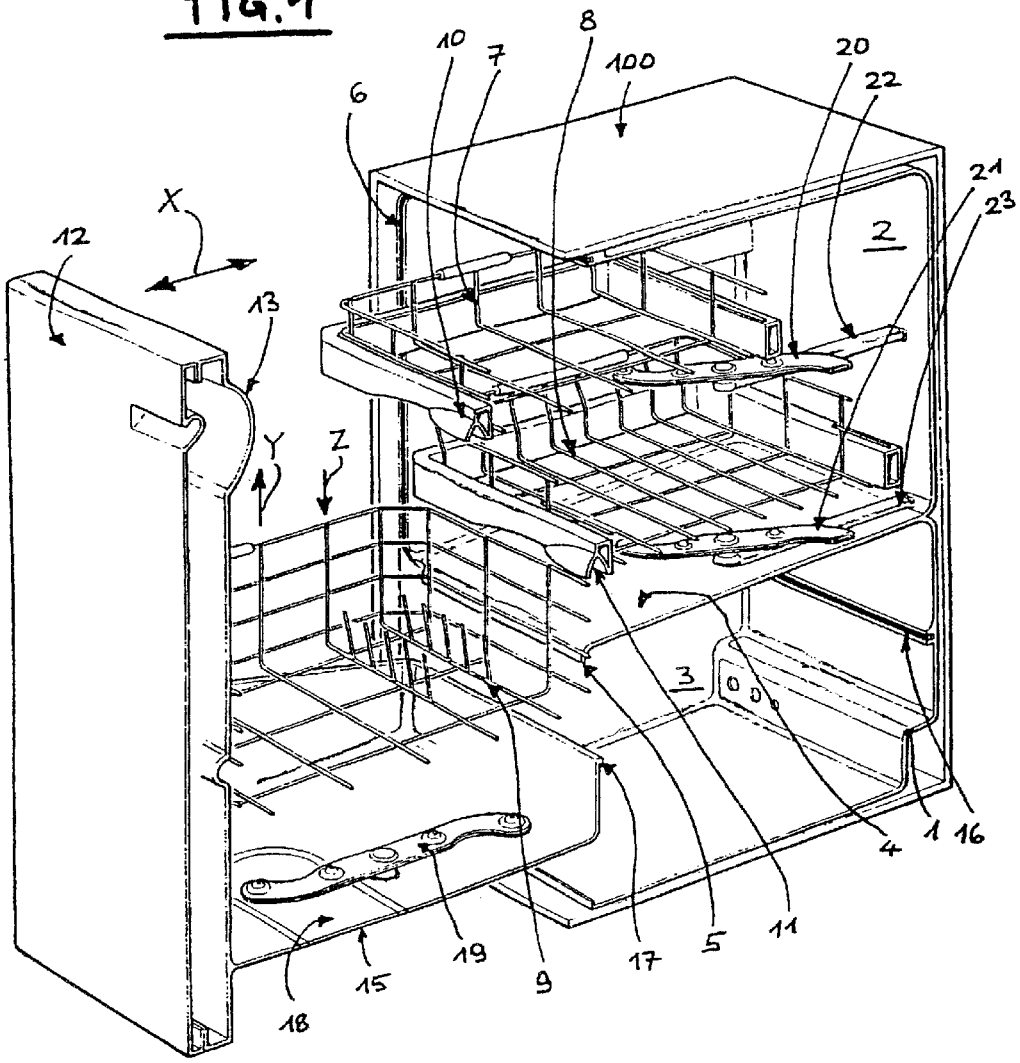
FIG. 1 is a three-dimensional view, cross-sectioned along a vertical plane in the depth direction, of a first embodiment of a dishwashing machine.

In the embodiment illustrated in FIG. 1, a dishwashing machine according to the present invention is of the so-called free-standing type and comprises an outer casing 100 having substantially the shape of a parallelepiped, fabricated conventionally out of painted sheet-steel and enclosing a housing 1. This housing 1, which is preferably of the structural, ie. self-bearing type according to the present invention, may be fabricated out of a metal alloy, such as for example stainless steel, or a thermoplastic material, such as polypropylene filed with calcium carbonate and other additives adapted to boost the surface gloss thereof. In the latter case, the housing 1 is preferably made as a single-piece construction, for instance by an injection-moulding technique. The housing 1 is anyway a water-tight design and forms a substantial part of the washing vessel of the machine, as this will be explained in greater detail further on. It consists of two compartments 2, 3 with a substantially horizontal partition wall 4 having its front edge folded downwards.

The front face 6 of the housing 1 is open, since it is adapted to allow for the racks 7, 8, 9 provided to support the washload items to pass therethrough during loading and unloading operations. The upper rack 7 and the middle rack 8 are capable of sliding, by means of per se known sliding or rolling means (not shown), along appropriate guides (not shown, either) provided on the side walls of the compartment 2 of the housing 1, with the help of appropriate front handles or grips 10, 11 provided to this purpose. According to a substantial feature of the present invention, the lower rack 9 is in turn joined to a door 12, whose inner surface is so sized as to be able to also accommodate the front bulk of the other two racks 8, 9, so that it is capable of shutting the whole aperture formed by the open front face 6 of the housing 1. The coupling between the lower rack 9 and the door 12 is such as to make these two parts of the dishwashing machine according to the present invention integral with each other in their horizontal sliding movements with respect to the housing 1, ie. capable of sliding jointly horizontally with respect to said housing, for opening and closing said open front face 6 thereof—see the double arrow X in FIG. 1. Moreover, the above cited coupling allows, when the door 12 is fully open, of course, for the rack 9 to be capable of raising and lowering vertically along the inner surface 13—see the arrow Y and the arrow Z in FIG. 1, respectively. These vertical displacements of the rack 9 may be carried out manually by the user, but are preferably brought about by appropriate mechanisms provided in the same door 12, which are however not shown in the accompanying drawings for reasons of greater simplicity, since they are generally known to those skilled in the art, and may for example comprise self-balancing gas springs or a stepper motor and associated worm screw.

A further important feature of the present invention lies in the presence of a body 15 having substantially the shape of a pan or the like, preferably made in a single piece, ie. integral with (or anyway firmly joined to) the inner surface 13 of the door 12, which is provided to perform a number of functions.

In the first place, it is on the side walls thereof that conventional rolling or sliding means (not shown, for reasons of greater simplicity) are provided, which, in association with guides (not shown, either) provided on the side walls of the compartment 3, ensure the support of the door 12 by the housing 1 and enable it to slide in the directions shown by the arrow X in the afore mentioned manner.

In the second place, the pan-like body 15 forms, when the door 12 is in its closed position, of course, a part of the washing vessel of the dishwashing machine, the remaining part thereof being formed by the housing 1 from the top of the upper compartment 2 to the circumferential sealing gasket 16 that lies at a certain height of the walls of the lower compartment 3 and is adapted to accommodate the terminal edge 17 of the same pan-like body 15. To this purpose, the bottom 18 of the latter comprises the apertures (not shown) for filling in and letting out the wash liquor and sustains, among other things, at least one of the rotating spray arms 19 that are adapted to spray the liquor onto the washload items during the operational cycles of the machine.

To complete the description of the dishwashing machine illustrated in FIG. 1, the presence should be noticed of two further rotating spray arms 20, 21 that are supplied via traditional pipes 22, 23 carrying the wash liquor, and are adapted to spray said liquor onto the washload items loaded in the upper rack 7 and the middle rack 8, respectively. From the illustration appearing in the same Figure, it can also be easily inferred how the partition wall 4 with its front edge 5 is provided to also act as a drip pan or similar arrangement.

Figure 2:
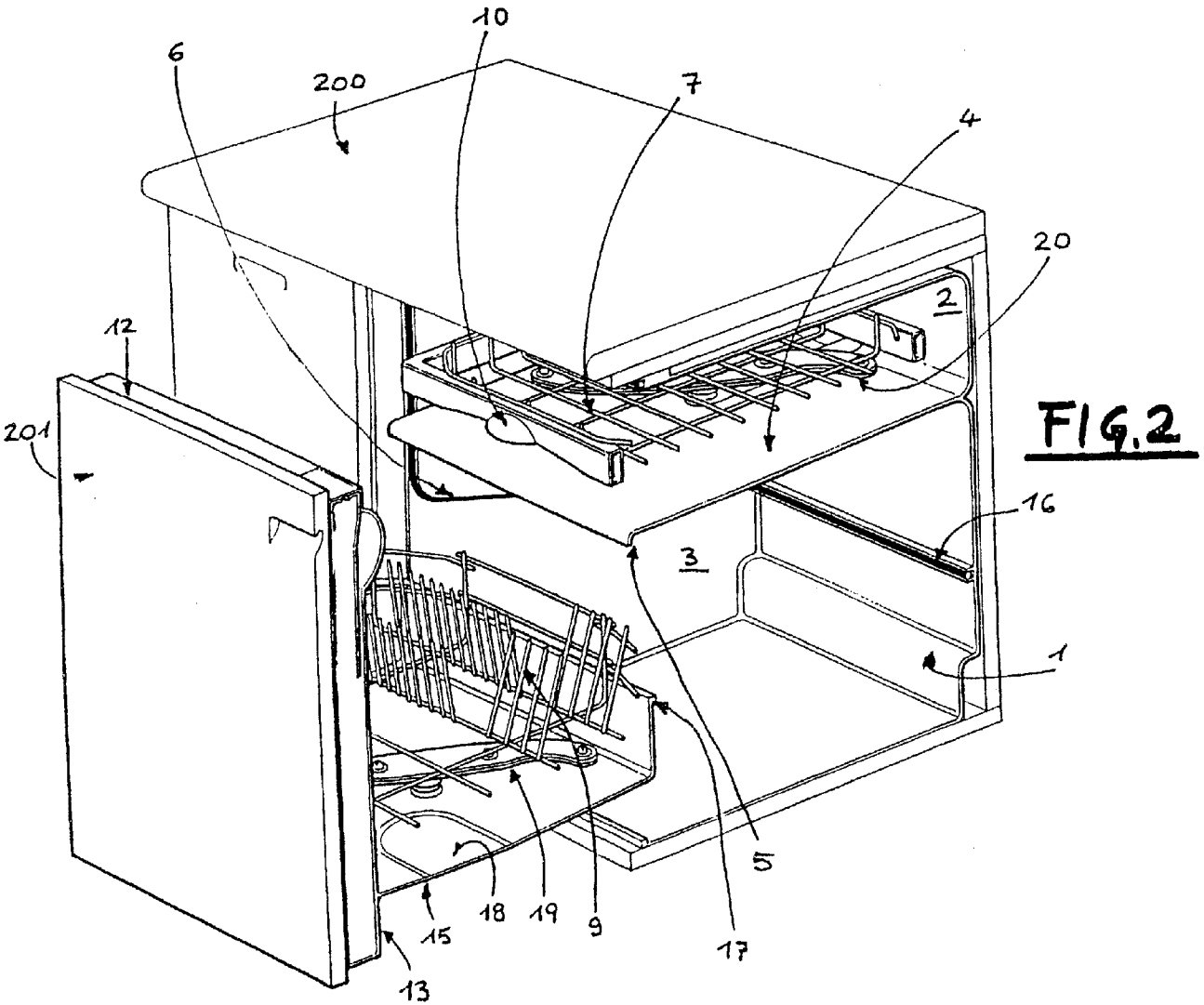
FIG. 2 is similar to FIG. 1 and illustrates a second embodiment of the dishwashing machine.

Referring now to FIG. 2, it can in the first place be noticed that, for greater convenience, the same reference numerals have been used here as in FIG. 1 to indicate the various parts of the dishwashing machine. The basic difference lies here in the fact that this particular embodiment is adapted to be built into an appropriate compartment of a kitchen cabinet 200. Owing to the fact that the housing 1 is of a self-bearing type, as already mentioned earlier in this description, this dishwashing machine does not need any outer casing, so that, for the same dimensions of the accommodating compartment of the kitchen cabinet, it practically offers a greater useful volume as compared with traditional machines.

The door 12 of the machine is equipped in a conventional manner with a well-known decorating outer panel 201.

Furthermore, again in the embodiment illustrated in FIG. 2 the position of the partition wall 4 in the interior of the housing 1 is such that only the racks 7, 9 and the corresponding rotating spray arms 20, 19 can be actually accommodated in the latter. The lower rack 9 is moreover designed in such a manner as to be particularly adapted to support considerably large-sized items, including pans and pots, oven trays and grids, grids and pan supports of gas-fired cooktops, and the like.

Figure 3:
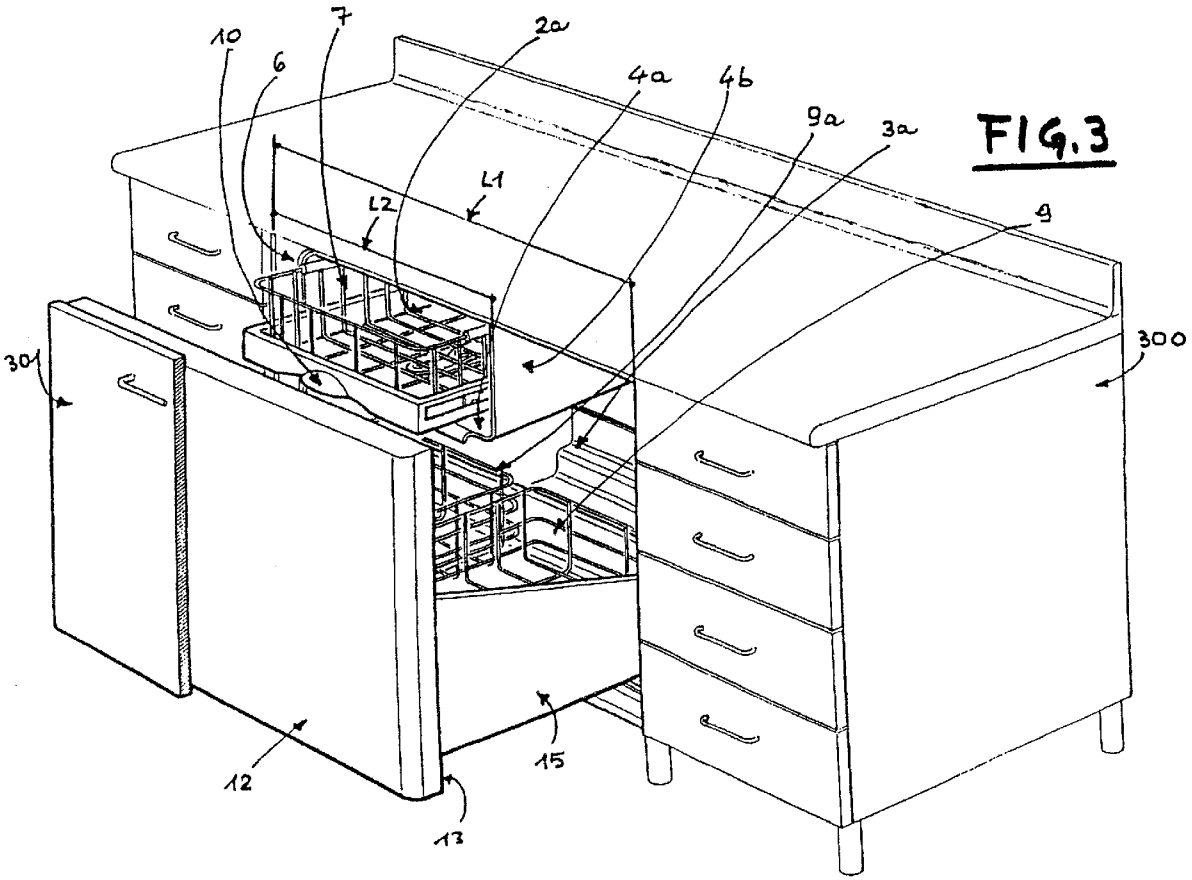
FIG. 3 is a view of a third and more complex embodiment, in which the dishwashing machine is illustrated as a view similar to the ones appearing in the above Figures, but built into a modern kitchen cabinet.

Referring finally to the embodiment illustrated in FIG. 3, which is also designed for built-in installation in an appropriate compartment of a kitchen cabinet 300, and where it can be noticed that the same reference numerals have again been used as in FIGS. 1 and 2 to indicate the various parts of the dishwashing machine, following peculiarities become immediately apparent:

- the nominal width L1 of the dishwashing machine is indisputably larger than in both the previously described embodiments and the generality of the traditional machine designs. for instance 90 or 120 cm instead of 45 or 60 cm;
- to the inner surface of the door 12*a* there are joined two racks 9, 9*a* in the same manner described for the sole rack 9 in the previously considered embodiments;
- to the purpose of ensuring that the washload items loaded on the racks 9, 9*a* are capable of being actually sprayed in an effective manner, to each one of such racks there is associated a respective rotating spray arm (not shown), which are both sustained by the bottom of the pan-like body 15*a* in the manner as already described with reference to the embodiment illustrated in FIG. 1;
- the internal subdivision of the housing is brought about by means of a vertical partition wall 4*b* that extends the substantially horizontal partition wall 4*a* upwards, so that the upper compartment 2*a* has a width L2 which is noticeably smaller than the width L1 of the machine (eg., L2=0.5 L1);
- the second compartment 3*a* of the housing of the machine is in this way given the shape of a "L", since the lower portion thereof has approx. the width L1 and the upper portion thereof a width L1–L2. In this way, the rack 9*a*, which lies practically below the compartment 2*a*, is adapted to support dishes, plates and other middle-sized washload items, whereas the rack 9 is adapted to also support washload items that may be even very large in their size.

It will be appreciated that the present invention may be implemented with a number of further variants, such as by way of non-limiting example the following ones:

the embodiment illustrated in FIG. 3 may be designed so as to be suitable for free-standing installation with the addition of an outer casing similar to the one indicated generally at 100 in the illustration of FIG. 1;

the embodiment illustrated in FIG. 1 can in turn be designed so as to be suitable for built-in installation in a kitchen cabinet, such as the one generally indicated at 200 in FIG. 2, by eliminating the outer casing 100 from the machine.

In all cases, the advantages of the present invention can be summarized as follows:

the internal arrangement of the housing provides a great extent of flexibility as far as both the dimensions (width) of the different models of dishwashing machine and the types and form of items are concerned that can be washed with the machine itself;

by shutting the door of the machine, which is made by pushing the same door in the horizontal direction, all racks, that had formerly been caused to move and protrude from the open front face of the housing to allow for the washload items to be conveniently loaded thereon, are at the same time and jointly caused to slide back to their closed position;

loading and unloading the washload items, including the heavier and/or larger-sized ones that may be arranged on the racks of the machine, in particular on the lower ones, does not create any inconvenience to the user;

the extent to which the lower racks can be readily pulled out from the washing vessel does not suffer any of the typical restraints that are normally experienced in the current dishwashing machines, since this does not take place on the inner surface of the machine door;

the possibility for the outer casing to be eliminated, at least in some embodiments of the machine, further to reducing the manufacturing costs of the washing machines and the number of component parts thereof, also enables the useful volume of the machine, ie. the quantity of washload items that can be loaded in the machine for washing, to be increased to a certain extent;

since the door of the machine moves only horizontally, no need is any longer felt, in the built-in versions, for the outer decorating panel thereof to be made shorter than the door itself in order to avoid any possible interference with the socle of the machine;

in the cases in which the housing of the machine and/or the inner surface of the door are each one made as a single piece of moulded thermoplastic material, the above mentioned reduction in the part count and the manufacturing cost of the dishwashing machine becomes still more conspicuous.

What is claimed is:

1. Dishwashing machine, comprising:

a stationary housing (1) having an open front face (6) to allow for t washload items to be loaded and unloaded, at least two structures (7, 8, 9; 9*a*) adapted to support the washload items and capable of sliding horizontally between a retracted and an extracted position with respect to the housing (1)

wherein at least one (9; 9*a*) of said support structures is integral, in its horizontal sliding movements, with a door (12) adapted to close the open front face (6) of the housing (1), and having an inner surface (13) that is able to accommodate a front bulk of at least another one of the remaining support structures (7,8) so as to cause it to slide back from an extracted to a retracted position when the door (12) is closed, wherein to promote convenience when loading and unloading the washload items, at least one (9) of said structures capable of sliding horizontally jointly with the door (12) is adapted to move in a substantially vertical direction along the inner surface (13) of the door (12).

2. The dishwashing machine according to claim 1, wherein two of said support structures (9, 9*a*) are adapted to slide jointly with the door (12) and are provided in a side-by-side arrangement with respect to each other.

3. The dishwashing machine according to claim 1, wherein in order to ensure such a vertical displacement of said support structure (9), on the inner surface (13) of the door (12) there are provided guide rails and at least a self-balancing gas spring.

4. The dishwashing machine according to claim 1, wherein in order to ensure such a vertical displacement of said support structure, on the inner surface (13) of the door (12) there are provided guide rails and at least a servo-mechanism.

5. The dishwashing machine according to claim 1, wherein extending from the a lower portion of the inner surface (13) of said door (12) towards an interior of the housing (1) there is a body (15), having substantially a pan-like shape, which constitutes a bottom of the a washing vessel of the machine, the remaining walls of the washing vessel being constituted by the walls of said housing (1).

6. The dishwashing machine according to claim 5, wherein at least the inner surface (13) of said door (12) and said pan-like shaped body (15) are made integrally as a single-piece construction.

7. The dishwashing machine according to claim 1, wherein said housing (1) is made as a single-piece construction, and is furthermore of the structural, type so that the machine does not need any structural outer casing.

8. The dishwashing machine according to any of the preceding claims, wherein in the interior of said housing (1) there is provided, a substantially horizontal wall (4) that subdivides the same housing into two compartments (2, 3) and, owing to its lying above said support structure (9) adapted to slide jointly with the door (12), acts essentially as a dripping surface for the washload items that are arranged on the support structures (7, 8) thereabove.

* * * * *

UNITED STATES PATENT AND TRADEMARK OFFICE

CERTIFICATE OF CORRECTION

PATENT NO. : 6,622,740 B1
DATED : September 23, 2003
INVENTOR(S) : Piero Durazzani It is certified that error appears in the above-identified patent and that said Letters Patent is hereby corrected as shown below:

Column 6,
Line 4, please delete "for t washload", and insert therefor -- for washload --.

Signed and Sealed this

Thirteenth Day of January, 2004

JON W. DUDAS
*Acting Director of the United States Patent and Trademark Office*